United States Patent [19]

Cohen

[11] Patent Number: 4,828,711

[45] Date of Patent: May 9, 1989

[54] METHOD AND APPARATUS FOR SEPARATING RELATIVELY MAGNETIC AND RELATIVELY NON-MAGNETIC MATERIALS

[75] Inventor: Henry E. Cohen, Middlesex, United Kingdom

[73] Assignee: GEC Mechanical Handling Limited, United Kingdom

[21] Appl. No.: 90,250

[22] PCT Filed: Dec. 10, 1986

[86] PCT No.: PCT/GB86/00753

§ 371 Date: Jul. 27, 1987

§ 102(e) Date: Jul. 27, 1987

[87] PCT Pub. No.: WO87/03511

PCT Pub. Date: Jun. 18, 1987

[30] Foreign Application Priority Data

Dec. 10, 1985 [GB] United Kingdom ..... 8530361

[51] Int. Cl.[4] ..... B03C 1/08

[52] U.S. Cl. ..... 210/695; 55/3; 55/100; 209/214; 209/223.1; 209/223.2; 209/232; 210/222

[58] Field of Search ..... 209/214, 478, 223.1, 209/232, 223.2; 55/2, 3, 100; 210/222, 223, 695

[56] References Cited

U.S. PATENT DOCUMENTS

| | | | |
|---|---|---|---|
| 263,131 | 8/1882 | Edison | 210/222 |
| 1,103,358 | 7/1914 | Hess | 210/222 |
| 3,608,718 | 9/1971 | Aubrey et al. | 210/222 |
| 3,767,545 | 10/1973 | Lucero | 210/222 X |
| 4,478,711 | 10/1984 | Cohen | 209/214 X |

FOREIGN PATENT DOCUMENTS 169774 1/1986 European Pat. Off. .

OTHER PUBLICATIONS

Hise, E. C., IEEE Transactions on Magnetics, vol. Mag 18, No. 3, May, 1982, "Development of High Gradient . . . ".

*Primary Examiner*—W. Gary Jones

*Attorney, Agent, or Firm*—Kirschstein, Kirschstein, Ottinger & Israel

[57] ABSTRACT

Separation of relatively magnetic and relatively non-magnetic particles suspended in a fluid medium is effected by feeding a stream of the medium across at least one end face of a magnet so as to cause the magnetic and non-magnetic particles to diverge and to be directed into separate collector channels.

13 Claims, 3 Drawing Sheets

METHOD AND APPARATUS FOR SEPARATING RELATIVELY MAGNETIC AND RELATIVELY NON-MAGNETIC MATERIALS

BACKGROUND OF THE INVENTION

This invention concerns magnetic separators and methods of use thereof. The invention applies to the separation of relatively magnetic and relatively non-magnetic materials which occur as particulate admixtures suspended in gaseous media. The invention further applies to the separation of such admixtures suspended in liquids, provided that sufficient magnetic force is available for overcoming fluid drag. The invention further applies to the separation of relatively magnetic fluids from relatively non-magnetic fluids. The invention further applies to the separation of particles from a fluid, if there is sufficient magnetic force for overcoming fluid drag and if there is sufficient difference in magnetic susceptibility, either the particles or the fluid exhibiting relatively higher magnetic susceptibility. The fluid may be a liquid, e.g. water or hydrocarbon compounds such as fuel oils, or it may be a suspension or an emulsion. The term "particle" as used above and throughout the specification refers to sizes ranging from sub-micrometres to several centimetres or more, unless particle size is more closely dictated in a specific context.

SUMMARY OF THE INVENTION

The invention, comprising apparatus design and method of separation, applies especially but not exclusively to the separation of particles bearing sulphur and iron impurities from pulverised coal. It is common practice to grind coal to fine sizes, typically below 200 micrometres, for combustion in electric power generation. The pulverised coal may be suspended in an air stream, or it may form a suspension in water or in fuel oil. In the pulverised coal, impurities such as waste stone, shale and iron sulphides occur as partly or fully liberated particles. One purpose of this invention is to enable such impurities to be removed as a magnetic reject, thus rendering cleaner coal for combustion, with higher calorific value and with lower sulphur content. The impurities can be removed by magnetic separation because typically they have higher magnetic susceptibilities than coal which is feebly diamagnetic. However, the magnetic susceptibilities of the impurities are generally weak and hence it is necessary to employ very strong magnetic forces. The preferred embodiment of this invention therefore employs a superconducting magnet so as to generate field strengths in excess of 2 Tesla. Normal copper coil magnets, or even permanent magnets may be used in other applications where the magnetic product may be of sufficiently high magnetic susceptibility. In general, stronger magnetic forces will permit higher rates of throughput for any given feed material.

According to the invention in its broadest aspect, separation is effected by feeding a stream of material containing relatively magnetic and relatively non-magnetic materials (hereinafter referred to simply as magnetic and non-magnetic materials) across at least one face of a solenoid coil magnet in a manner such as to cause the magnetic and non-magnetic materials to diverge during their passage past the magnet, and to be directed into separate collector channels.

The rate of feed and the magnetic force should, of course, be chosen such as to prevent magnetic material adhering to the magnet face or faces to any appreciable extent.

The solenoid coil magnet is conveniently associated with a duct through which the mixed material is fed at a controlled rate, the directional effects of the shape of the duct and the magnetic forces causing the divergence in the directions of travel of the non-magnetic and magnetic materials, such that they are directed into respective discharge channels from the duct.

Preferably the solenoid coil magnet is disposed in such a position within the duct that the stream of materials passes across the two faces of the solenoid coil magnet, so that the magnetic material is deflected both axially and radially inwards and passes to a central discharge channel, whilst the non-magnetic matrial passes to an outer discharge channel on each side of the solenoid.

Preferably the duct is fluid dynamically shaped so that the feed streams tend to be directed towards the outer discharge channels, the strength of the magnet in relation to the rate of feed being such that the magnetic material is diverted inwards and into the central discharge channels.

In some cases the relative widths of the mouths of the central and outer channels may be variable as by the provision of pivoted or otherwise movable splitters.

BRIEF DESCRIPTION OF THE DRAWINGS

One embodiment of the invention will now be described, by way of example, with reference to FIGS. 1 to 3 of the accompanying schematic drawings, in which.

DETAILED DESCRIPTION OF THE PREFERRED EMBODIMENTS

Figure 4:
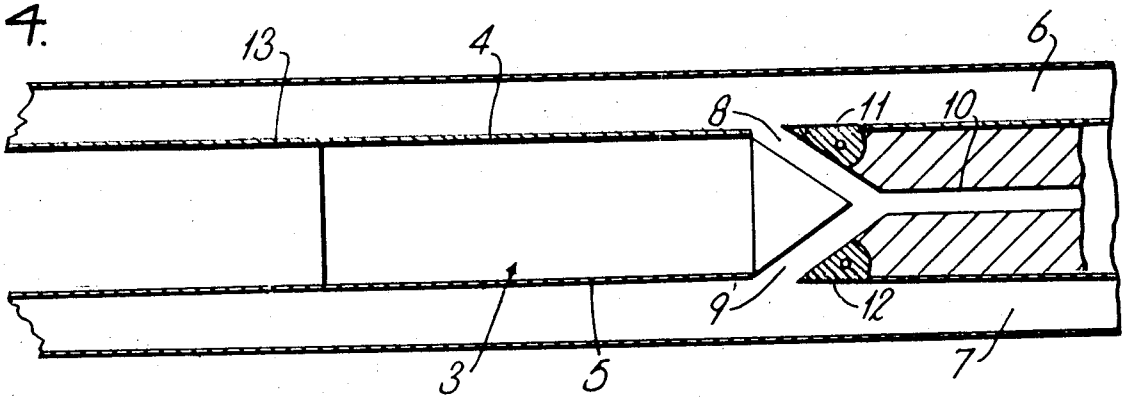
FIG. 4 represents an alternate magnetic separator.

The separator comprises a rectangular sectioned duct 1 into an end 2 of which is fed a stream of particulate material in suspension in a gaseous fluid. The duct is divided into two equal legs so that two streams move past a solenoid magnet 3 disposed centrally within the duct, passing its vertically disposed faces 4 and 5 respectively. Alternatively, as shown in FIG. 4, the magnet may be disposed between two ducts so as to act on materials fed through both ducts, the magnetic material being deflected axially and radially inwardly and passing into at least one collector channel through openings in the walls of the ducts. The magnet is enclosed in a smoothly contoured fairing 13 to reduce turbulence, the shape of the two legs of the duct at the sides of the fairing being such as to direct the flows towards receiver ducts 6 and 7 respectively. The magnetic forces will act across the flows, towards the faces 4 and 5, and also towards the central axis of the solenoid magnet. Hence, the relatively more magnetic material in the stream will be deflected inwards and travel towards the openings 8 and 9 respectively, leading to an outlet duct 10.

It is a particular characteristic of this invention that use is made of the combined directional effects of the external stray magentic field of a solenoid magnet. The circular solenoid is designed to generate field gradients (and hence directional magnetic forces) which increase axially towards the faces of the solenoid, as well as radially towards its axis. In consequence, magnetic particles approaching the solenoid from 2 in FIG. 1 will be drawn axially towards the magnet faces, and also radially towards the magnet axis as indicated by the chain lines 14 of FIG. 3. Thus, the stream of magnetic particles on each side of the magnet will be densified as its spread is reduced during passage across the first half of the respective magnet face 4 or 5. Thereafter, as the magnetic particles pass across the second half of the magnet face, they move against the radial magnetic forces which act towards the magnet axis. Hence, the particles will be slowed down progressively and this results in further densification of the magnetic product stream. The slower moving magnetic particles will displace outwards (away from the magnet face) any nonmagnetic particles which happen to travel in this region close to the magnet. This "magnetic density displacement" is akin to the gravity displacement which is essentially utilised in flowing film and other gravity separators. The displacement enhances the quality of the separated products.

Pivoted splitters 11 and 12 are located between opening 8 and receiver duct 6, and between opening 9 and receiver duct 7 respectively. These splitters can be turned inwards or outwards in order to adjust the cut for optimum separation between the central magnetic products and the two outer nonmagnetic products. This adjustment can be used to allow for different volumetric proportions of the products.

The relative cross-sectional areas of the regions of the duct for receiving magnetic and nonmagnetic products can be modified for specific feed materials so as to take account of the inherent ratios of the two products. For example, in the above cited case of cleaning coal the magnetic fraction may represent between 2 and 20% of the total feed mass. With other materials the magnetic fraction may be a majority component and this would require wider ducts for the magnetic product, with narrower ducts for the non-magnetic product.

The other means of operational control comprise (i) adjustment of the magnetic force by means of altering the coil current;

(ii) adjustment of the volumetric dilution of the feed stream by means of altering the proportion of gas in dry feeds, or of fluid in streams dispersed in water, oil or other liquids;

(iii) adjustment of the velocity of the stream passing the magnet;

(iv) differential adjustment of the velocities/volumes of the streams in the ducts receiving the magnetic and the nonmagnetic products respectively.

In general the magnetic force is always kept low enough, in relation to the magnetic susceptibility of the magnetic materials, as well as relative to the inertial and drag forces acting in the steam, so as not to cause significant capture of magnetics on the faces of the magnet.

Although in the general embodiment of the invention, as shown in the drawings, the separator is oriented in space so that the direction of the stream is generally horizontal and the faces 4 and 5 of the magnet are vertical, this orientation may be modified by leaving the faces 4 and 5 vertical, but inclining the ducts so that either the feed entry or the discharge points are higher or lower relative to each other. Thus with the faces 4 and 5 vertical, the ducts may be arranged, horizontal, inclined upwards, or inclined downwards from feed to discharge. In extreme positions, the feed entry may be vertically above or vertically below the discharge points, giving vertically upward or vertically downward flows respectively. The choice of directional attitude may be dictated by the nature of the feed material, by the streaming behaviour of the suspension, by the need to avoid segregation of particles due to size, shape or density, or more indirectly by space requirements in relation to adjacent equipment and plant lay-out.

Figure 1:
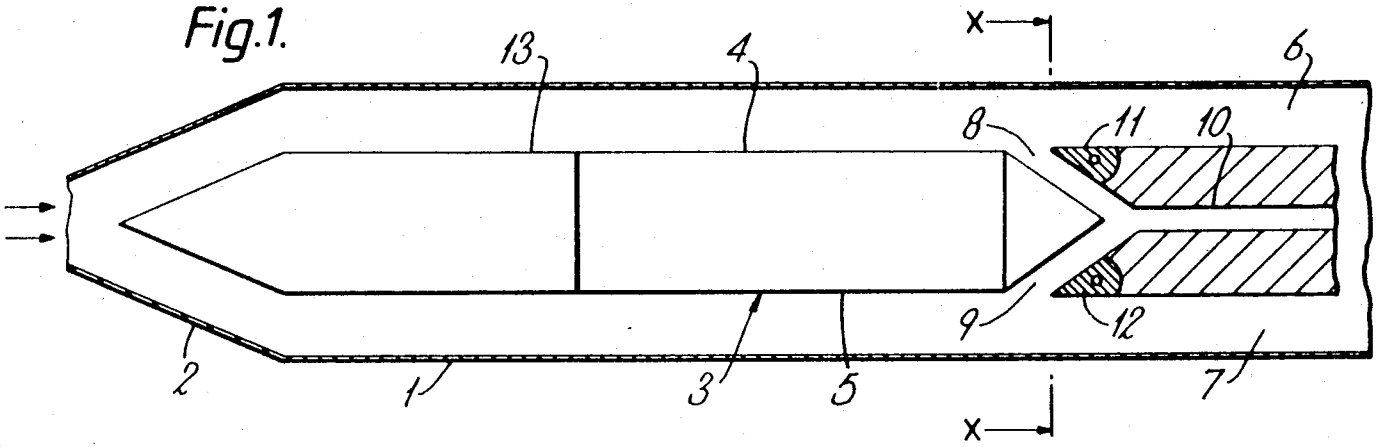
FIG. 1 represents a plan section of a magnetic separator in accordance with the invention in diagrammatic form.
Figure 2:
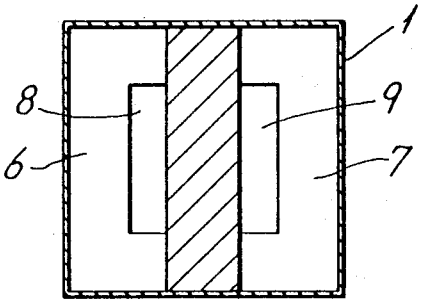
FIG. 2 represents a transverse section through the separator in the plane represented by the line X—X of FIG. 1.
Figure 3:
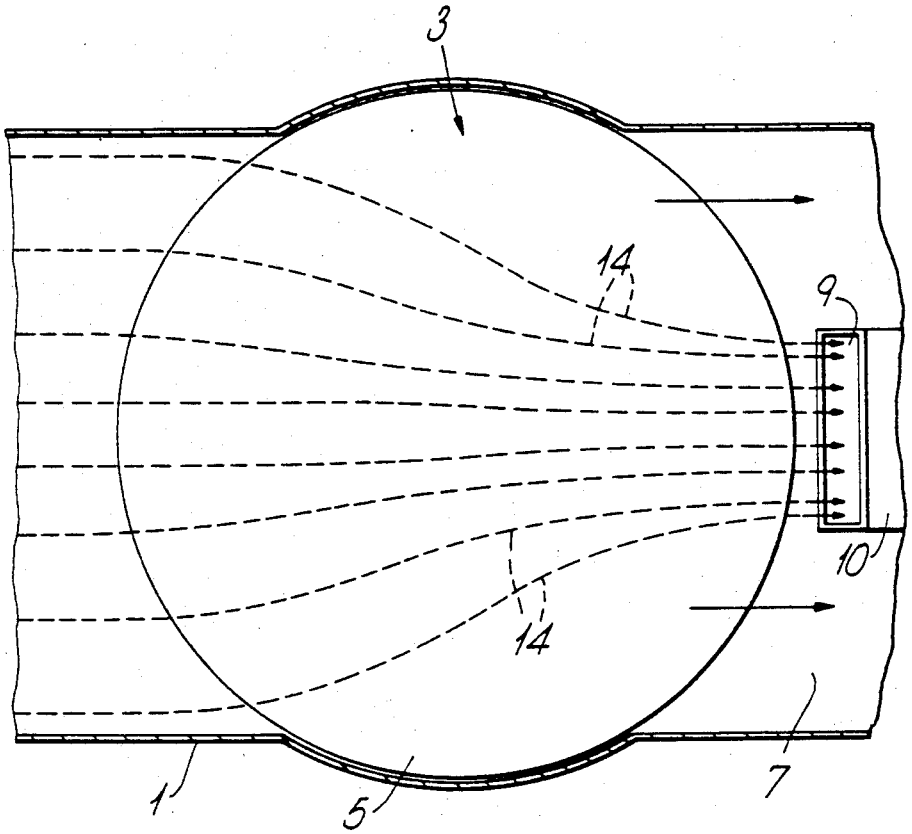
FIG. 3 represents, also diagrammatically, a sectional elevation of the separator.

Furthermore, if gravitational forces are relatively subordinate, compared with the magnetic, inertial and fluid forces, the separator may be arranged so that the magnet faces 4 and 5 are horizontal, one above the other, or in some other angular orientation between vertical and horizontal. The ducts are always arranged so that the feed material streams past the magnet faces 4 and 5 as indicated in FIG. 1 and 3 irrespective of the spatial attitude of the separator.

Dry feed material may be blown through the separator by means of maintaining pressure differentials between feed and discharge points. This can be used further for controlling the division of products by arranging greater or lesser pressure differentials between the feed and discharge ports 6 and 7 for nonmagnetic products and discharge ports 8 and 9 for magnetic products respectively. For example, separate suction fans may be incorporated in the discharge ducts for magnetic and nonmagnetic products.

Alternatively, dry feed materials may be allowed to fall past the magnet under the influence of gravitational acceleration, with or without the use of air flows induced by pressure differentials. The choice of transport would depend on specific characteristics of a given feed material, including particle sizes, particle shapes and proportions of magnetic components.

For feed material in liquid suspensions, the flow of the feed material may be induced and controlled by pumping and/or by gravitational acceleration.

For optimal separations, with dry or wet feeds it is desirable to maintain steady flow conditions so as to establish a stable balance in the deflection of material into the magnetic product ducts at 8 and 9.

The positioning of the splitters 11 and 12 may be fixed and arranged by trial for a given feed material. Alternatively the positioning may be continuously adjustable and controlled by various process parameters. For example, magnetic detectors in the product ducts and/or differential flow meters, pressure gauges and other sensing devices can be used to maintain some pre-set conditions.

The above operational aspects are quoted only to show the practical flexibility of the invention in adjusting its basic concept to varying feed materials and to meet product specifications.

The invention can also be used to separate from a mixture of different materials, particles which are not inherently magnetic, but which can be rendered magnetic, at least temporarily, prior to the separation process. In some cases this can be achieved by incorporating into the mixture a finely divided ferromagnetic material which is more readily adherent to or absorbed by designated particles than by other particles in the mixture.

Such a process may be used for the separation of some biological materials from a liquid containing them, or from a mixture of those materials from a liquid containing them, or from a mixture of those materials and other materials which are less susceptible than said magnetic material, for example for purifying purposes, or for eliminating undesirable elements from a liquid or admixture of particles in both the food and other industries.

I claim:

1. A method of separating relatively magnetic material from relatively non-magnetic material, comprising the steps of:

(a) feeding a fluid stream having a mixture of said materials at a controlled rate through a duct containing a solenoid coil magnet having two faces disposed in a central position within the duct and an axis transverse to the duct, said stream being fed to and past the faces of the magnet;

(b) energizing the magnet to produce a magnetic field sufficient to cause the relatively magnetic material to flow past the magnet in a direction of travel different from that of the relatively non-magnetic material, said magnetic material being deflected both axially and radially inwardly toward the energized magnet; and (c) directing the deflected magnetic material, after its passage past the magnet into an inner discharge channel at an outlet end of the duct, and directing the non-magnetic material to an outer discharge channel on each side of the inner discharge channel.

2. A method according to claim 1 wherein the magnetic and non-magnetic materials consist of particulate materials in a separate fluid medium.

3. A method according to claim 1 wherein the magnetic and non-magnetic materials are in the form of fluids.

4. A method according to claim 1 wherein at least one of the magnetic and non-magnetic materials consists of a fluid and the other of the non-magentic and magnetic materials is in particulate form.

5. A method according to claim 1 wherein the solenoid coil magnet is a superconducting magnet.

6. A magnetic separator apparatus, comprising:

(a) a duct having an outlet end;

(b) a solenoid coil magnet disposed within the duct and having an axis transverse to the duct, said magnet having an end face spaced from an adjacent wall of the duct;

(c) means for feeding a stream having a mixture of relatively magnetic and relatively non-magnetic materials through the duct across said end face of the magnet;

(d) means for energizing the magnet to produce a magnetic field sufficient to cause the relatively magnetic material to be deflected toward said end face of the magnet as it is fed past said end face; and (e) means located at said outlet end of the duct, for forming outlet channels positioned so that one outlet channel receives the magnetic material deflected by the magnetic field, and another outlet channel receives the non-magnetic material.

7. Apparatus according to claim 6 having splitter means disposed in the path of said stream as it is fed past the magnet, the position of the splitter means being adjustable to vary the proportions of the magnetic and non-magnetic materials fed into said respective outlet channels.

8. A magnetic separator apparatus according to claim 6 or wherein the magnet is a superconducting magnet.

9. A magnetic separator according to claim 6 including means for controlling the rate at which the stream is fed through the duct.

10. A magnetic separator according to claim 6 wherein the magnet has another end face disposed within the duct such that the stream passes across both faces of the magnet.

11. A magnetic separator according to claim 10 wherein the duct is fluid dynamically shaped such that the stream tends to be directed towards two outer discharge channels, the strength of the magnetic field deflecting the magnetic material inwards and into an inner discharge channel.

12. A magnetic separator apparatus according to claim 6 including means for adjusting the field strength of the magnet.

13. A method of separating relatively magnetic material from relatively non-magnetic material, comprising the steps of:

(a) feeding a fluid stream having a mixture of said materials at a controlled rate through two ducts disposed on each side of a solenoid coil magnet, said stream being fed to and past the magnet;

(b) energizing the magnet to produce a magnetic field sufficient to cause the materials in the two ducts to diverge during their passage past the magnet, said magnetic material being deflected both axially and radially inwardly toward the energized magnet; and (c) directing the deflected magnetic material, after its passage past the magnet into at least one collector channel through openings in the walls of the ducts.

* * * * *